United States Patent [19]

Stefan et al.

[11] Patent Number: 4,699,180

[45] Date of Patent: Oct. 13, 1987

[54] VIBRATION DAMPING MOUNTING FOR A WEAVING MACHINE

[75] Inventors: Ammann Stefan; Herzig Marcel, both of Winterthur, Switzerland

[73] Assignee: Sulzer Brothers, Ltd., Winterthur, Switzerland

[21] Appl. No.: 906,318

[22] Filed: Sep. 11, 1986

[30] Foreign Application Priority Data

Sep. 24, 1985 [CH] Switzerland ..... 4127/85

[51] Int. Cl.[4] ..... D03J 1/00

[52] U.S. Cl. ..... 139/1 R; 248/615; 248/638

[58] Field of Search ..... 139/1 R; 248/615, 619, 248/633, 636, 638, 559, 600

[56] References Cited

U.S. PATENT DOCUMENTS 3,160,376 12/1964 Kennedy et al. ..... 139/1 R
3,282,543 11/1966 Engels ..... 139/1 R
4,587,995 5/1986 Bolleter et al. ..... 139/1 R

*Primary Examiner*—Henry S. Jaudon

*Attorney, Agent, or Firm*—Kenyon & Kenyon

[57] ABSTRACT

The vibration-damping mounting for the weaving machine comprises a number of bearing elements which rest on the weaving shed floor. The bearing elements are relatively rigid vertically and are resilient only horizontally. For good horizontal vibration damping, the spring rate of the bearing elements referred to the total mass of a weaving machine must not exceed the value $$6.6 \times 10^2 \frac{N}{m} \frac{1}{kg},$$

horizontally, while the spring rates of the bearing elements should be at least 10 times greater. With this kind of mounting, which is of more use particularly for weaving machine frames not having great torsional resistance, the environment near a weaving machine group experiences in practice surprisingly low amplitudes of vibration which are many times less than the amplitudes of vibration associated with a rigid machine mounting.

9 Claims, 4 Drawing Figures

VIBRATION DAMPING MOUNTING FOR A WEAVING MACHINE

This invention relates to a vibration damping mounting for a weaving machine.

As is known, the operating cycles of individual heavy parts or of entire subassemblies of a weaving machine may result in the foundation of the machine experiencing forces likely to cause excessive vibrations in the immediate vicinity of the machine or, if the ground by which a textile works is built is unsatisfactory, in the vicinity of the textile works. In extreme cases, there may even be excessive impairment of comfort in the surrounding dwellings or possibly structural damage.

In order to compensate or eliminate the excessive vibrations from the weaving machine, it has been known to mount weaving machines on vibration damping mountings. For example, U.S. Pat. No. 4,587,995 describes a mounting for a weaving machine in which the spring rates of the warp-side bearing elements differ by at least one order of magnitude from the spring rates of the cloth-side bearing elements. In this kind of mounting, for example, the cloth-side bearing elements below the feet of the machine with an average mass of 4500 kilograms can take the form of relatively soft air-filled rubber bearings having a vertical spring rate $k_v$ of $0.35\times10^6$ N/m per element while the warp-side bearing elements can have a much higher spring rate $k_v$ of $21\times10^6$ N/m. The horizontal spring rate of both kinds of element is less than $1\times10^6$ N/m and is therefore considerably below the value of the greatest vertical spring rate.

Spring rate $k_v=0.35\times10^{16}$ N/m, for example means that a force of $0.35\times10^{13}$ N (Newton) must be applied to effect a spring deformation of 1 millimeter (mm). The spring rate is the quotient of a force P divided by the deformation f of the spring under the force P $k_v=p/f$.

Consequently, the rigid body natural frequencies which arise in horizontal and vertical oscillations lie well below the first order of the excitation frequency of modern high-performance weaving machines. As compared with a rigidly mounted weaving machine, the mounting acccording to the above-noted U.S. Patent considerably reduces the transmission of horizontal and vertical vibrations into the floor of the weaving shed and the propagation of such vibrations.

However, this kind of mounting is of use only for weaving machines which have a torsionally rigid and, therefore, relatively heavy frame. If the machine frame is relatively light, i.e. of a mass less than 5,000 kilograms and of low torsional resistance, the mounting elements cannot readily be devised to be soft vertically, for if they are, the machine frame may experience excessive distortions.

Based upon experience, a weaving machine cannot be supported by soft bearings if the machine has a light weight structure because of possible inadmissible deformations within the machine.

The torsional resistance of the frame of a weaving machine should be greater than $R=10^7\ N\ m^2$ if soft bearings are applied.

"Torsional resistance" is defined as $R=J\times G$, wherein:

J=moment of inertia with respect to torsion $(J)=m^4$

G=modulus of shear $(G)=N/m^2$

The angle $\alpha$ of twist of a frame can be calculated by $$\alpha=\frac{M\times L}{R},$$

wherein:

M=torsional moment (M)=Nm and

L=length of frame of the weaving machine (L)=m

Accordingly, it is an object of the invention to provide a machine mounting for weaving machines enabling relatively lightweight machines to be assembled with effective vibration damping.

It is another object of the invention to provide a relatively simple vibration damping mounting for a lightweight weaving machine.

Briefly, the invention provides a vibration damping mounting for a weaving machine which has a plurality of feet for supporting the machine on a floor. In accordance with the invention, the mounting includes a plurality of bearing elements, each of which is disposed under a respective foot and each of which has a vertical spring rate greater by at least one order of magnitude, i.e. by a factor of 10, than a horizontal spring rate thereof. The bearing elements are thus characterized by a spring tuning which is relatively soft only in the horizontal direction. Further, the sum of the horizontal spring rates of the bearing elements relative to the mass of the weaving machine is at most $6.6\times10^2$ N/m (kg).

The bearing elements are such that the spring rates of the discrete elements are of the same order of magnitude of each case horizontally and vertically. With these bearing elements, the weaving machine supported on the elements can vibrate horizontally but can only undergo relatively reduced vertical oscillations.

The bearing elements may be made of a laminated construction, for example with a plurality of soft elastomeric plastic layers interleaved with plane stiffening plates of the equal horizontal dimensions. Also, the bearing elements may be stacked one above the other, for example so that a pair of bearing elements support a foot of the weaving machine.

Still further, the varying elements may be made of different horizontal areas from each other. However, in this case, each element supports a constant load per unit area.

These and other objects and advantages of the invention will become more apparent from the following detailed description taken in conjunction with the accompanying drawings wherein.

Figure 1:
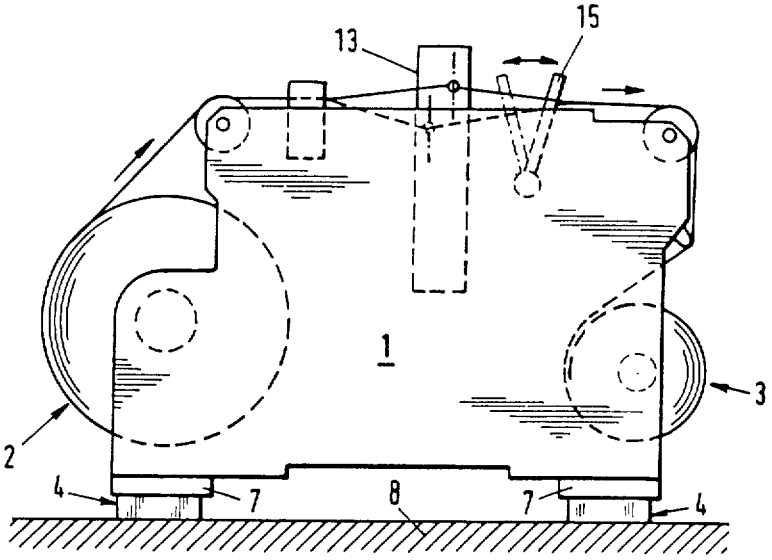
FIG. 1 illustrates a diagrammatic view of a weaving machine having a mounting in accordance with the invention.

Referring to FIG. 1, the weaving machine 1 is of conventional structure and mounts a warp beam 2 at one end from which warp yarns are unwound and a cloth beam 3 at an opposite end for taking up the finished cloth or fabric. As indicated, the machine 1 is carried by a vibration damping mounting composed of a plurality of bearing elements 4 on a floor 8 of a weaving shed. Each element 4 is disposed under and secured to a respective foot 7 of the machine in a suitable manner.

The bearing elements 4 may be of identical construction or, may have different horizontal support areas in dependence upon the distribution of the weight of the machine 1 among the feet 7. However, the ratio of the foot load per unit support area is constant for all the bearing elements 4. In order to simplify manufacture of such bearing elements, it is of advantage to use a unitary vertical construction.

Figure 2:
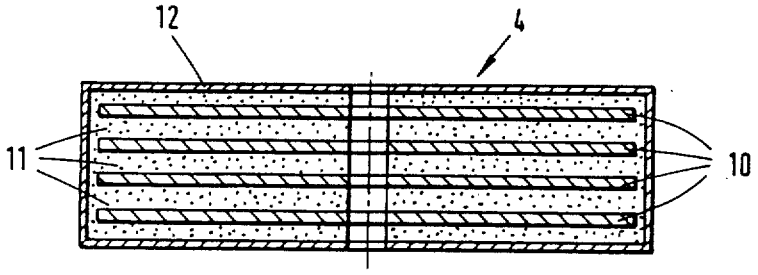
FIG. 2 illustrates a cross sectional view of a bearing element constructed in accordance with the invention.

Referring to FIG. 2, each bearing element 4 may be in the form of a rotationally symmetrical laminated construction. As indicated, the bearing element includes a number of stiffening or strengthening plates or panels 10 which are placed one above another and are made of a material having a relatively high modulus of elasticity, such as aluminum, and which are interleaved with plastic layers 11 made of a relatively soft material having a low modulus of elasticity, such as a soft elastomeric material, for example a chloroprene rubber. The plastic layers 11 serve to determine the resilient properties of the bearing element 4.

Figure 3:
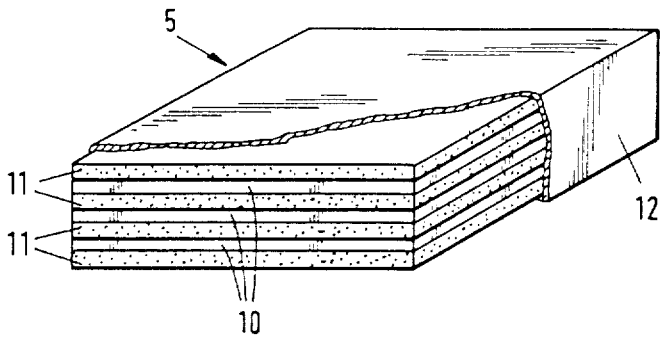
FIG. 3 illustrates a perspective view of a modified laminated bearing element in accordance with the invention.

Referring to FIG. 3, wherein like reference characters indicate like parts as above, the bearing element 5 may be made with a rectangular cross section and with a sheet 12 that extends completely around the laminated element.

Figure 4:
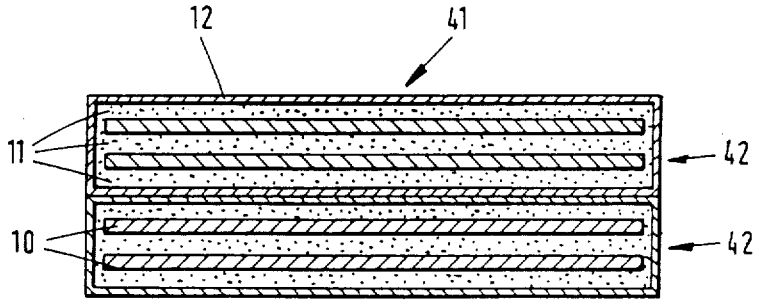
FIG. 4 illustrates a stacked arrangement of bearing elements in accordance with the invention.

Referring to FIG. 4, a bearing element 41 may also be made of stacked bearing elements 42 to function as a composite bearing element. In this regard, in order to adapt the properties of discrete bearing elements to weaving machines in which the foot loads are unequal one or two bearing elements 41 may be stacked. As indicated, each bearing element 42 has three soft plastic layers 11 interleaved with two harder stiffening plates or panels 10 with a sheet 12 encompassing the layers 11 and plates 10.

Of note, a single bearing element 42 may be used in place of a composite bearing element 41 where only half the spring rate is required, for example for a less heavily loaded foot of a weaving machine.

Referring to FIG. 1, the largest parts or subassemblies of a weaving machine which are reciprocated in a weaving cycle are the heddles 13 with the associated drive elements (not shown) and a sley 15. Generally, the vibrations of the machine propagated through the feet 7 into the shed floor 8 are mainly caused by the oscillation of the sley 15. Because of the resilient construction of the bearing elements 4, these vibrations cannot be transmitted undamped to the shed floor 8.

The dimensions of the bearing elements 4, 5 and the stiffnesses of the stiffening plates or panels 10 and plastics layers 11, in the case of a laminated bearing, should be such that the sum of the spring rates of all the bearing elements 4, 5 referred to the mass of a weaving machine 1 horizontally does not excess $$6.6 \times 10^2 \frac{N}{m} \cdot \frac{1}{kg},$$

while the spring rates tramsversely thereto in the vertical direction should be about ten times this value. In the case of a weaving machine assembled with bearing elements as described above, a rigid-body natural frequency of the order of approximately 5 Hz results but the excitation frequency is around 10 Hz. Consequently, the machine oscillates horizontally in the supercritical range, a significant factor in connection with the required effective damping of horizontal vibrations. Good vibration damping is abandoned vertically because of the harder springing as compared with the horizontal direction, so that the vertical forces transmitted to the weaving shed floor 8 remain considerably greater than the horizontal forces thus transmitted.

However, extensive measurements made in the immediate and less immediate vicinity of a group of weaving machines having bearing elements as described above have shown that a soft mounting solely in the horizontal direction can considerably reduce the amplitudes of vertical vibration. In dwellings adjacent the group of machines, the amplitudes of vibratory speed measured on machines mounted on these elements are only approximately 33% of the amplitudes produced by rigidly mounted machines. These tests showed that satisfactory insulation operative solely horizontally between the environment and vibrating weaving machines can provide satisfactory vibration damping in other directions at some distance away from the machines.

The bearing elements may also be constructed in other manners, for example as laminated bearings as described in U.S. Pat. No. 4,587,995.

The invention thus provides a vibration damping mounting which can be used for relatively lightweight weaving machines having relatively low torsional resistance for example, weaving machines having a mass less than 5000 kilograms. The mounting is such as to significantly reduce any vibration transferred to a shed floor and to a surrounding environment.

What is claimed is:

1. In combination, a weaving machine having a plurality of feet for supporting said machine on a floor; and a vibration damping mounting for said machine, said mounting including a plurality of bearing elements, each said bearing element being disposed under a respective foot and having a vertical spring rate greater by at least one order of magnitude than a horizontal spring rate thereof, and wherein the sum of said horizontal spring rates of said bearing elements relative to the mass of said weaving machine being at most $$6.6 \times 10^2 \frac{N}{m} \cdot \frac{1}{kg}.$$

2. The combination as set forth in claim 1 wherein each bearing element is laminated with a plurality of soft elastomeric plastic layers interleaved with plane stiffening plates of equal horizontal dimensions.

3. The combination as set forth in claim 1 wherein a pair of said bearing elements is stocked under at least one foot.

4. The combination as set forth in claim 1 wherein each bearing element supports a constant load per unit area with at least some bearing elements having a greater horizontal area than the remainder of said bearing elements.

5. The combination as set forth in claim 1 wherein said weaving machine is of relatively light weight and relatively low torsional resistance.

6. A vibration damping mounting for a weaving machine comprising a plurality of bearing elements, each said bearing element having a vertical spring rate greater by at least one order of magnitude than a horizontal spring rate thereof, and wherein the sum of said horizontal spring rates is at most $$6.6 \times 10^2 \frac{N}{m} \frac{1}{kg}.$$

7. A vibration damping mounting as set forth in claim 6 wherein each bearing element is laminated with a plurality of soft elastomeric plastic layers interleaved with plane sitffening plates of equal horizontal dimensions.

8. The combination as set forth in claim 1 wherein each said bearing element has a vertical spring rate and a horizontal spring rate of the same order of magnitude of the remaining bearing elements.

9. A vibration damping mounting as set forth in claim 6 wherein each bearing element has a horizontal spring rate and a vertical spring rate of the same order magnitude of the remaining bearing elements.

* * * * *

UNITED STATES PATENT AND TRADEMARK OFFICE

CERTIFICATE OF CORRECTION

PATENT NO. : 4,699,180

DATED : October 13, 1987

INVENTOR(S) : Ammann Stefan; Herzig Marcel

It is certified that error appears in the above-identified patent and that said Letters Patent is hereby corrected as shown below:

Column 2, line 34 "of" should be -as-
Column 3, line 57 "excess" should be -exceed-
Column 3, line 62 "tramsversely" should be -transversely-
Column 4, line 55 "stocked" should be -stacked-
Column 6, line 6 "of" should be -as-
Column 6, line 10 "of" should be -as-

Signed and Sealed this

Fourteenth Day of June, 1988

*Attest:*

DONALD J. QUIGG

*Attesting Officer*

*Commissioner of Patents and Trademarks*